US008631617B2

(12) United States Patent
Janesky

(10) Patent No.: US 8,631,617 B2
(45) Date of Patent: Jan. 21, 2014

(54) WALL PANEL SYSTEM

(76) Inventor: Lawrence M. Janesky, Seymour, CT (US)

( * ) Notice: Subject to any disclaimer, the term of this patent is extended or adjusted under 35 U.S.C. 154(b) by 586 days.

(21) Appl. No.: 11/757,741

(22) Filed: Jun. 4, 2007

(65) Prior Publication Data

US 2008/0295439 A1 Dec. 4, 2008

(51) Int. Cl.
*E04B 1/38* (2006.01)

(52) U.S. Cl.
USPC ..... 52/282.1; 52/302.3; 52/506.06

(58) Field of Classification Search
USPC ..... 54/302.3, 282.1, 56.06, 512, 762, 772, 54/781; 52/302.3, 282.1, 56.06, 512, 762, 52/772, 781, 408
See application file for complete search history.

(56) References Cited

U.S. PATENT DOCUMENTS 4,075,800 A * 2/1978 Molick ..... 52/169.5
4,869,032 A * 9/1989 Geske ..... 52/169.5
4,937,990 A * 7/1990 Paquette ..... 52/199
5,170,603 A 12/1992 Bartlett
5,501,044 A * 3/1996 Janesky ..... 52/169.5
5,535,556 A * 7/1996 Hughes, Jr. ..... 52/169.5
5,715,638 A * 2/1998 Anderson, Sr. ..... 52/506.08
5,890,334 A 4/1999 Hughes, Jr.
6,247,280 B1 * 6/2001 Grinshpun et al. ..... 52/309.12
6,318,041 B1 11/2001 Stanley
6,588,165 B1 * 7/2003 Wright ..... 52/506.05
6,676,506 B2 * 1/2004 Steneby et al. ..... 454/186
6,918,212 B1 7/2005 Anderson, Sr.
7,137,225 B2 11/2006 Zuppan
7,181,888 B1 * 2/2007 Facaros ..... 52/169.5
7,313,891 B2 * 1/2008 Showers ..... 52/267
2004/0219853 A1 * 11/2004 Weir et al. ..... 442/327
2006/0283113 A1 * 12/2006 Trotter ..... 52/302.3
2008/0295439 A1 12/2008 Janesky

* cited by examiner

*Primary Examiner* — Brian Glessner
*Assistant Examiner* — Adam Barlow
(74) *Attorney, Agent, or Firm* — Perman & Green, LLP

(57) ABSTRACT

A wall paneling system including at least one finish wall panel configured to prevent moisture from entering an interior of the wall panel and having a finish with a predetermined finished characteristic thereon and a drainage system configured to remove moisture directed into the drainage system by the at least one wall panel.

25 Claims, 15 Drawing Sheets

WALL PANEL SYSTEM

BACKGROUND

1. Field

The present embodiments relate to panel systems and, more particularly, to wall panel systems.

2. Brief Description of Related Developments

It has been common for homeowners to buy a home with unfinished rooms, such as basements, and then later to finish such rooms (e.g. when the homeowner's finances improve, or as the homeowner's family grows). It is also becoming more common for homeowners to specify that they want such historically unfinished rooms as basements in new houses finished at the time the houses are built. Builders are often reluctant to finish the basements of new residential constructions, however, because there is always a greater level of uncertainty during the first several years of a new construction's life as to whether foundation cracks or other problems will arise, and the existence of a finished basement generally makes repair of such defects more costly for the builder.

Conventional systems for finishing rooms such as basements include attaching a framework to a masonry wall, and panels are attached to the framework by complementary hook and loop fasteners. In these hook and loop systems spaces exist between the panels and the framework to allow removal of the panels from the framework. These spaces may allow cold air, water and other unwanted substances from entering the finished portion of the room.

Other paneling systems use rigid support panels that provide a relatively hard wall surface that is likely to be acoustically reflective over a wide midrange of frequencies (such as those common in human speech, television programs, etc.) and thus can tend to provide little acoustical insulation benefit. These rigid panels are held in place with screw attachments that can be relatively time consuming to install, require additional time to cover to form an acceptably attractive wall surface, and make it difficult to achieve a nondestructive modular system in which wall panels can be easily removed and replaced.

Other conventional paneling systems include padded panels where the padding is secured to a rigid backing with tufting buttons. The tufting buttons are then secured through the padded cover to the backing layer such that the outer surface of the panel has a tufted configuration to provide a unique visual relief. The panels are preferably secured to each other by a plurality of dowel pins frictionally fitting into holes in the frames. These panels require a large number of steps to manufacture, and appear to be relatively time consuming to install, due to the need to interconnect the panels with dowel pins.

Still other conventional finishing systems include attachment of wood studs roughly every 16 to 24 inches to a cinder block or masonry wall and the attachment of a wall surface such as drywall or paneling to the wood studs by attachment means such as nails or screws. Generally, insulation such as glass fiber insulation batts are placed between the wall and the wall surface before attachment of the wall surface to the wood studs, or a granular or loose-fill fibrous insulation is poured or blown in to the space between the wall and the wall surface after the wall surface is attached to the wood studs.

Some wall finishing systems have modular panels that are inserted into frame members. The frame members are attached to the wall and have a snap in connector for retaining the panels against the frame members. These modular panels have a fabric covering that extends over the front, top, bottom and sides of the panel. Other modular paneling systems include a vapor barrier on the back side of the panel.

The above mentioned conventional wall finishing techniques/systems do not provide protection from, for example, water entering the interior of the room finished with the paneling as the panels are not compatible with the small gaps used in typical drainage systems. In addition, the panels or wall surfaces of these conventional wall systems allows water to enter the panels which may cause mold growth and/or deterioration of the panel as well as allowing water to drip on a floor beneath the panel. Other panels made of thin plastic sheets have been tucked into drainage systems but these plastic sheets are not insulated and no not provide a thermal break.

It would be advantageous to have an decorative and insulative wall paneling system that provides a water barrier for the living area created by the paneling system as well as a water barrier for the panel itself. It would also be advantageous to have a decorative wall paneling system that drains any moisture that may build up between a wall and the panels.

SUMMARY

In one exemplary embodiment, a wall panel is provided. The wall panel includes a front surface, a back surface, a first side surface connecting the front and back surfaces, a second side surface connecting the front and back surfaces, a bottom surface connecting the front and back surfaces and a vapor barrier covering at least the back surface and the bottom surface.

In another exemplary embodiment, a wall panel is provided. The wall panel includes a fiberglass core, a finished front surface joined to a first side of the fiberglass core, the front surface comprising a fascia with a predetermined finish characteristic thereon and a back surface joined to a second side of the fiberglass core, the back surface comprising a vapor barrier.

In another exemplary embodiment, a wall paneling system is provided. The wall paneling system includes at least one finish wall panel configured to prevent moisture from entering an interior of the wall panel and having a fascia with a predetermined finish characteristic thereon and a drainage system configured to remove moisture directed into the drainage system by the at least one wall panel.

In still another exemplary embodiment, a room finishing, insulation and water drainage system is provided. The room finishing, insulation and water drainage system includes at least one insulative wall panel configured to be installed over a wall surface in a room and to prevent a passage of moisture through the panel and into the room and a drainage system configured to remove moisture directed into the drainage system by the at least one insulative wall panel.

BRIEF DESCRIPTION OF THE DRAWINGS

The foregoing aspects and other features of the disclosed embodiments are explained in the following description, taken in connection with the accompanying drawings, wherein.

DETAILED DESCRIPTION OF THE EXEMPLARY EMBODIMENT(S)

Figures 1A, 1B, 1C:
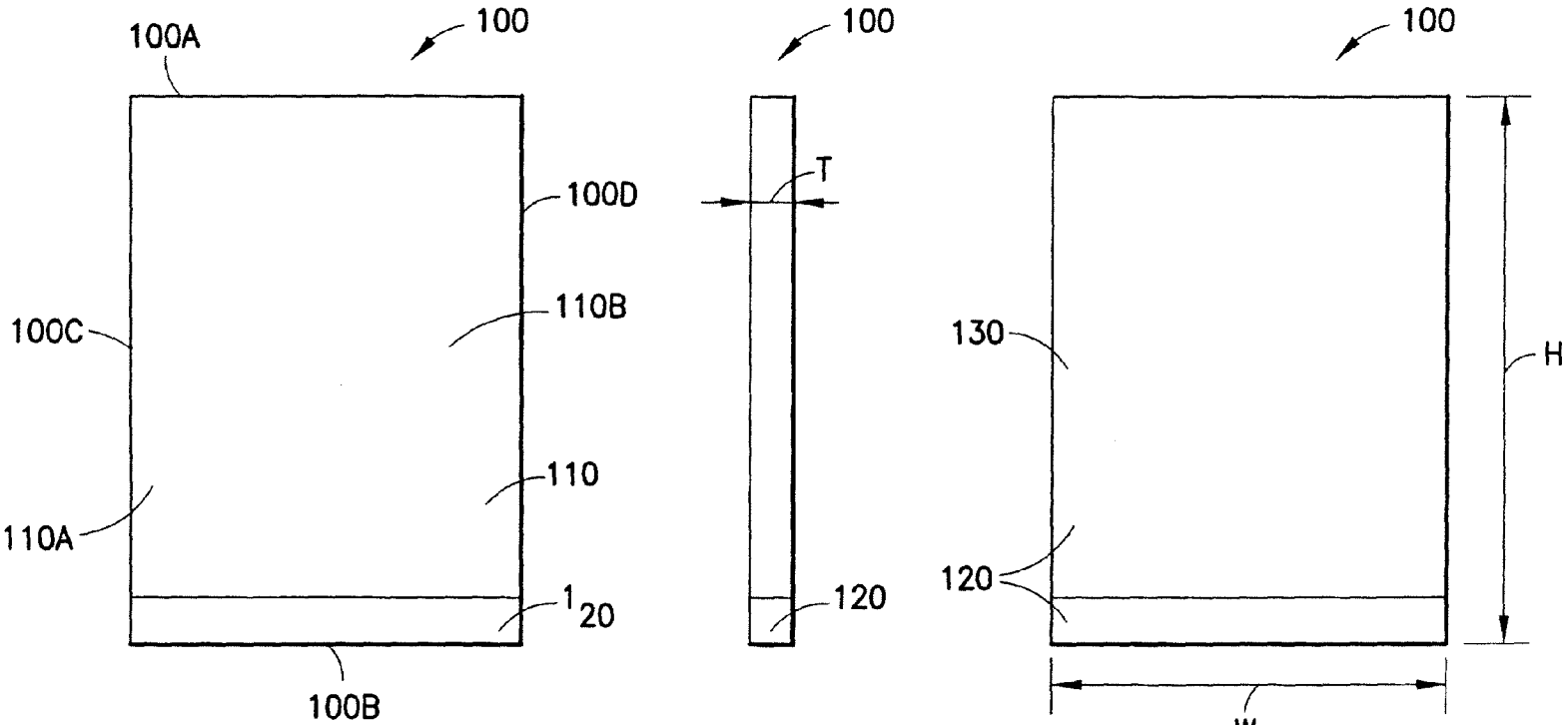
FIGS. 1A-C are schematic illustrations of the front side and back, respectively, of a panel in accordance with an exemplary embodiment.

FIG. 1 illustrates a wall panel 100 in accordance with an exemplary embodiment. Although the embodiments disclosed will be described with reference to the embodiments shown in the drawings, it should be understood that the embodiments disclosed can be embodied in many alternate forms of embodiments. In addition, any suitable size, shape or type of elements or materials could be used.

As can be seen in FIGS. 1A-C the wall panel 100 has a generally rectangular shape but in alternate embodiments the wall panel may have any suitable shape including, but not limited to square, triangular, oval and round so that the panel can be utilized along any suitable wall surface. The wall panel 100 may also have any suitable width W and/or height H to accommodate any suitable ceiling height and/or wall lengths. For exemplary purposes only, the wall panel may have width W of about thirty inches and a height of about eight feet to accommodate a standard ceiling height. In alternate embodiments the panel 100 may have a height H of more or less than eight feet and a width W of more or less than thirty inches. As may be realized the smaller the width W of the panel 100 the easier it may be to handle the panel 100 during installation. As also may be realized, the greater the width W of the panel 100 the fewer the seems between the panels 100 along any given wall surface. In alternate embodiments, the wall panels may also be cut to size and suitable vapor barrier material, as will be described below, may be provided with the panel to seal the panel after cutting. The panel 100 may also have any suitable thickness T or density to accommodate any suitable insulative properties. For exemplary purposes only the panel 100 may have a thickness T of about 5/16 of an inch and a density of about 10 lbs/ft$^3$ but in alternate embodiments, the thickness of the panel 100 may be more or less than 5/16 of an inch and the density may be more or less than 10 lbs/ft$^3$. As may be realized, the thickness T of the panel 100 may vary depending on the density of the panel 100. For example, lower density panels, may have a greater thickness and vice versa.

The wall panel 100 may be constructed of any suitable material including, but not limited to, fiberglass, fiberboard, closed cell foam, structural foam, plastic or any combination thereof. The panel 100 may have a single layer of material that makes up the panel thickness or the panel may have multiple layers. For example, the panel may include an insulating portion and a support portion. The support portion may be any suitable material that gives the panel its shape and structural strength so that the panel may be self supporting and will not sag or otherwise deform when the panel is installed over a surface. In another example, the insulative material of the panel may be a structural insulating material to allow for a single layer panel. In one exemplary embodiment the panel 100 may have resilient properties (i.e. the panel may be flexible) so that the panel 100 can be flexed during installation. In alternate embodiments the panel 100 may be a substantially rigid panel.

The wall panel 100 may include a front surface 110, a back surface 130, a top surface 100A, a bottom surface 100B and side surfaces 100C, 100D. The front surface 110 may have any suitable finish characteristic 110B. The finish characteristic may include, but not limited to, textures, patterns and/or colors. In one exemplary embodiment the finish characteristic 110B may be applied to, for example, the front surface 110 of the panel 100 as a decorative fascia 110A. For example, the fascia 110A on the front surface 110 may include a fabric to provide acoustic dampening and a soft wall surface. In another example, the fascia 110A may include a vinyl surface. In alternate embodiments the fascia 110A may be any suitable material having any suitable aesthetic or acoustic properties to match the decor and or any suitable acoustic qualities of a user's home. The fascia 110A may be fixed to the panel in any suitable manner including, but not limited to, mechanical fasteners, adhesives and/or chemical fasteners. The fascia 110A may or may not wrap around the edges of the panel 100. In alternate embodiments the texture, patterns and colors may be formed on the surface of the panel such as during manufacture of the panel.

The back surface 130 of the panel 100 may include any suitable backing such as, for example, a vapor barrier 120 to prevent the passage of moisture through the panel 100 and into the living area. The vapor barrier 120 may also cover exposed fibers of the panel 100 and prevent contact between the panel 100 and a wetted surface such as, for example, a basement wall. As can be seen in FIG. 1A-1C, the vapor barrier 120 may wrap around the bottom 100B of the panel 100. The vapor barrier may also extend over a portion of the front surface 110. The vapor barrier 120 may extend underneath the fascia on the front surface 110 or over the top of the fascia. The vapor barrier 120 may also wrap around at least a portion of the sides 100C, 100D of the panel. The vapor barrier 120 may substantially seal the bottom portion of the panel 100 to prevent moisture from entering the bottom portion of the panel by, for example, capillary action. In alternate embodiments the vapor barrier may extend over any suitable portion of the panel. For example, the vapor barrier may cover the entire panel or any portion thereof. The vapor barrier may include, but is not limited to, air gaps between the wall surface and the back of the panel, reflective foil, paper-backed aluminum, polyethylene plastic sheet, treated paper such as waxed paper, vapor barrier paints, and metal sheets. In alternate embodiments the vapor barrier may be any suitable vapor barrier. The sealing of the panel 100, as described above, may allow the panel 100 to be placed or installed against a wetted surface without having any deterioration of the panel or seepage of moisture through or into the panel. As may be realized the paneling system described herein may also be employed over or adjacent to dry wall surfaces. The back surface 130 of the panel 100 may be embossed to provide a dimple pattern or have grooves to allow for drainage of any moisture that may exists between the panel 100 and the wall surface to which it is mounted on. The embossing or grooving of the back surface 130 of the panel 100 may also allow for adjustability when the panel 100 is mounted on an uneven surface. In alternate embodiments, the back of the panel may have any suitable texture.

The panel 100 may be one of a series of panels that are installed over a surface such as a wall. The panel 100 may be held against or in close proximity to the wall in any suitable manner such as by, for example, attachment strips or trim pieces as can be seen in FIGS. 2-6A. The attachment strips may include end trim pieces 200, intermediate or spanning trim pieces 300, 300', inside corner trim pieces 400, outside corner trim pieces 500 and top and bottom trim pieces 600. The trim pieces may have any suitable finish (e.g. fascias, colors and textures) so that the trim pieces blend in with and match the fascia 110A of the panel 100. In alternate embodiments, the trim pieces may not match the fascia 110A of the panel 100. The trim pieces may be held against a wall surface in any suitable manner including, but not limited to mechanical fasteners, chemical fasteners or adhesives. For example, the trim pieces may be provided with holes so that a nail or screw, depending on the wall surface, can be inserted through the hole and into the wall surface. In another example, the trim pieces can be glued to the wall surface. In yet another example, the trim pieces may snap into or otherwise engage a separate mounting piece, where only the mounting piece is affixed to the wall so that the trim pieces can be easily removed. In one embodiment, the trim pieces may have suitable standoffs extending from the back of the trim pieces so that a gap is created between the wall surface and the back of the trim pieces (and the panels when the panels are installed) to allow for moisture drainage. In alternate embodiments the panel 100 may be attached directly to the wall with for example, mechanical or chemical fasteners or adhesives.

Figure 2:
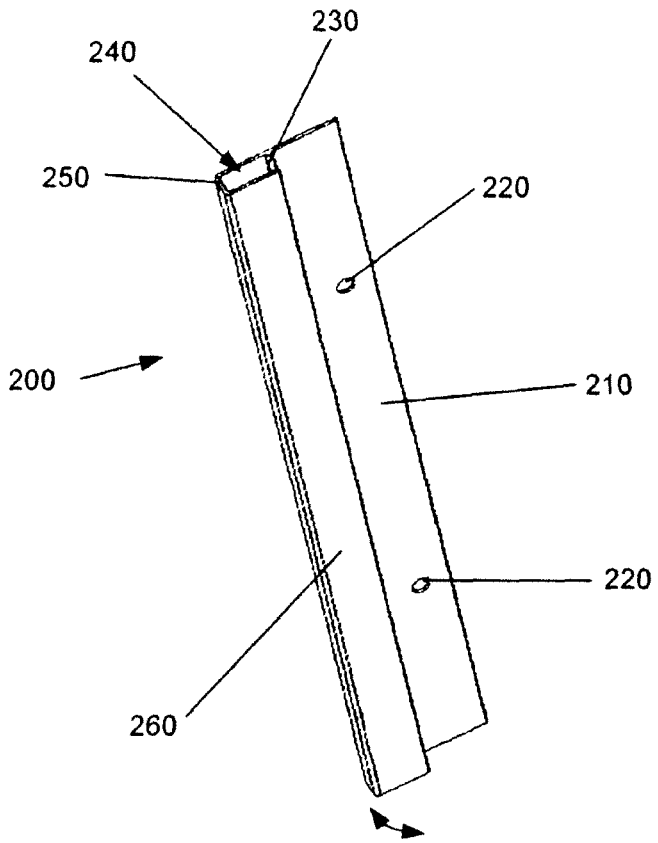
FIG. 2 illustrates a schematic view of a trim piece in accordance with an exemplary embodiment.

Referring now to FIG. 2, an exemplary end trim piece 200 is shown. The trim piece may have any suitable length. For example, the end trim piece 200 may have a length that is substantially equal to the height H of the panel 100. In alternate embodiments the trim piece 200 may have a length that is greater or less than the height H of the panel 100. The trim piece 200 may be made of any suitable material including, but not limited to, plastics, metals, composites or any combination thereof. In this exemplary embodiment, the end trim piece 200 includes a back portion 210 having at least one aperture 220 and a channel portion 240. The back portion may be resiliently flexible, for example allowing back portion to be bent in order to allow the channel portion 240 some freedom of movement to aid in mounting and removal of the panel. In alternate embodiments the end trim piece 200 may have any suitable configuration. The channel portion may include a back portion, which may be part of the back portion 210, a side portion 250 that covers the end of the panel 100 when the trim is installed and a front portion 260 that covers a portion of the front 110 of the panel when the trim is installed over an end of the panel 100. The apertures 220 may be located in any suitable position along the back portion 210 of the end trim piece 200. As can be seen in FIG. 2, the end trim piece 200 may be configured to wrap around an end of the panel so that a finished edge is formed. The end trim piece may also have a protrusion 230 that holds the trim piece 200 on the panel 100 when the panel is inserted into the channel. The protrusion 230 may partially extend into the panel and hold the trim piece 200 on the panel 100 by, for example, frictional forces or a spring force created by the channel itself that forces the protrusion 230 into the panel 100. In alternate embodiments any suitable retainer may be utilized to hold the trim piece 200 on the panel 100. As may be realized the protrusion may provide a temporary fastening of the trim piece 200 to the panel while a more permanent fastening is performed by the fasteners 700 as will be described below with respect to FIG. 7.

Figure 3B:
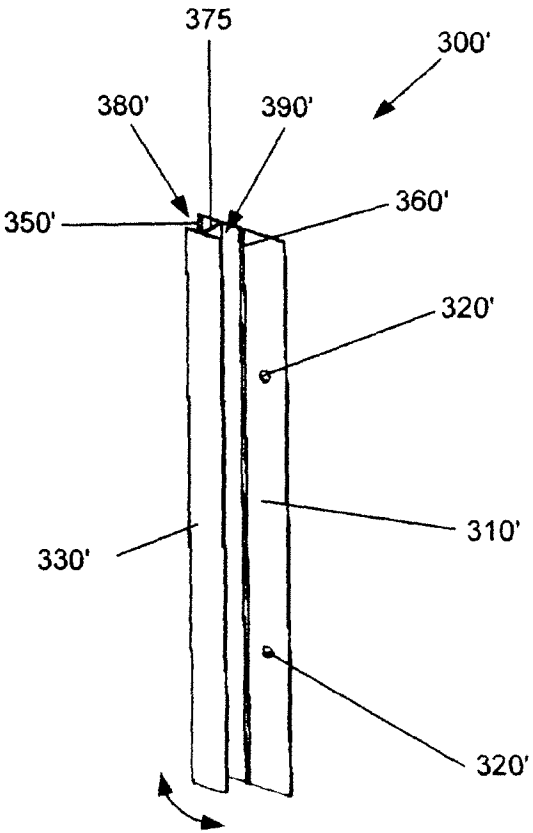
FIGS. 3A-B illustrates schematic views of another trim piece in accordance with an exemplary embodiment.
Figure 3A:
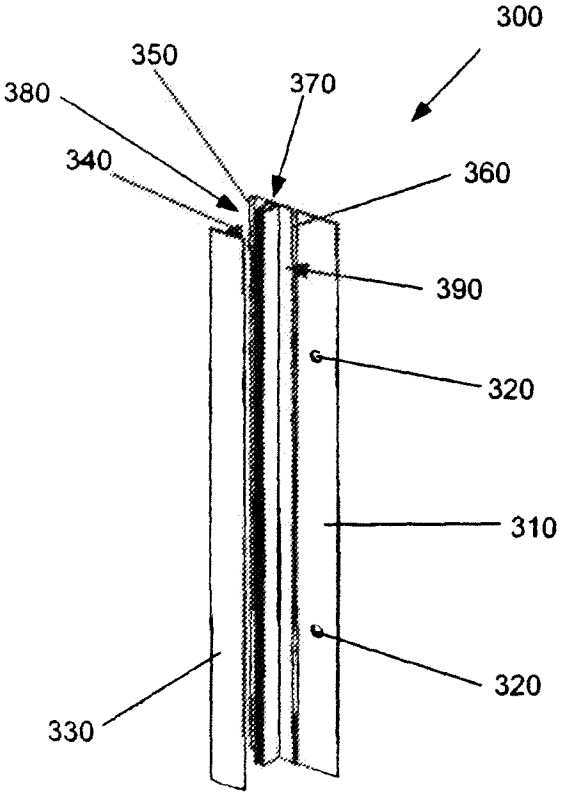

Referring to FIG. 3A, an exemplary intermediate or spanning trim piece 300 is shown. The spanning trim piece 300 may have any suitable length. For example, the spanning trim piece 300 may have a length that is substantially equal to the height H of the panel 100. In alternate embodiments the trim piece 300 may have a length that is greater or less than the height H of the panel 100. The trim piece 300 may be made of any suitable material including, but not limited to, plastics, metals, composites or any combination thereof. The spanning trim piece 300 may be configured to span the joint between two pieces of panel 100 and provide a finished look at the joint. For example, the trim piece 300 may include a back portion 310 having at least one aperture 320, a first channel portion 380 and a second channel portion 390. The back portion may be resiliently flexible, for example allowing the back portion to be bent in order to allow the channel portion 240 some freedom of movement to aid in mounting and removal of the panel. The first and second channel portions 380, 390 may be formed by the back portion 310, the center channel 370 and the cover 330. In this exemplary embodiment, shown in FIG. 3A the spanning trim piece 300 may have a two piece construction. In alternate embodiments the spanning trim piece 300 may be constructed of more or less than two pieces. The center channel 370 includes two protrusions that extend away from and substantially perpendicular to the back portion 310. The cover 330 includes a protrusion or barb 340 that fits into the center channel 370. The barb 340 may snap into the center channel 370 so that the cover 330 is retained. The trim piece may also include protrusions 350, 360 that are substantially similar to protrusion 230 described above with respect to FIG. 2. In use, a first panel may be place up against one side of the center channel 270 while a second panel may be placed up against the other side of the center channel 270. The cover 330 may be inserted into the center channel 270 such that the retaining force of the cover 330 in the center channel 270 forces the protrusions 350, 360 into the panel to retain the trim piece on the panels. The trim piece can be more permanently fixed to the panel or vice versa by the fasteners 700. In this exemplary embodiment, the spanning trim piece is shown as being asymmetrical in that only one side of the trim piece has apertures 320 for securing the panel to the trim piece 300. In alternate embodiments, the trim piece 300 may be symmetrical such that both sides of the trim piece have apertures 320 for fastening the panel, though the trim piece may be fastened, for example to a wall or other base, using the fastening holes on but one side. In other embodiments, the trim piece may be symmetrical where the apertures 320 are only located on one side of the trim piece 300.

As can be seen in FIG. 3B, an exemplary one piece spanning trim piece 300' is shown. The trim piece 300' may be substantially similar to trim piece 300 described above. For example, the trim piece 300' may include a back portion 310' having at least one aperture 320', a first channel portion 380' and a second channel portion 390'. The first and second channel portions 380', 390' may be formed by the back portion 310' and the cover 330'. In this exemplary embodiment, the cover is attached to the back portion 310' with a piece of webbing 375 that is formed between the back 310' and the cover 330'. The back portion may be resiliently flexible, for example allowing the back portion to be bent in order to allow the channel portion 240 some freedom of movement to aid in mounting and removal of the panel.

Figure 4:
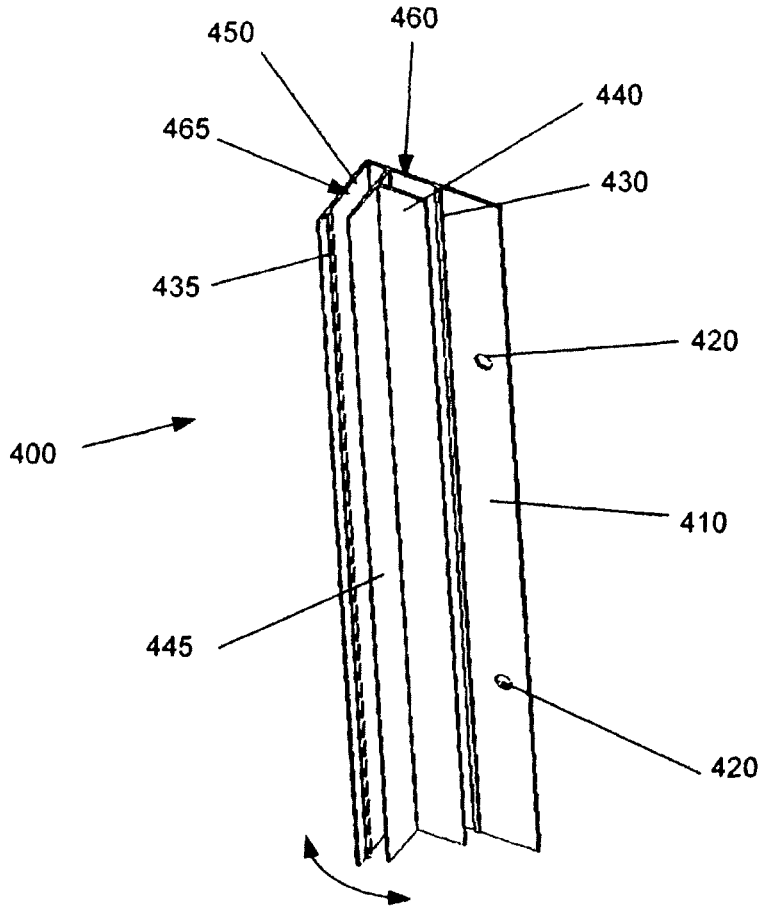
FIG. 4 shows a schematic view of still another trim piece in accordance with an exemplary embodiment.

An exemplary inside corner trim piece 400 is shown in FIG. 4. The inside corner trim piece 400 may have any suitable length. For example, the inside corner trim piece 400 may have a length that is substantially equal to the height H of the panel 100. In alternate embodiments the trim piece 400 may have a length that is greater or less than the height H of the panel 100. The trim piece 400 may be made of any suitable material including, but not limited to, plastics, metals, composites or any combination thereof. The inside corner trim piece 400 may be configured to span the corner joint between two pieces of panel 100 and provide a finished look at the corner joint. For example, the inside corner trim piece 400 may have a first back portion 410 and a second back portion 450 that substantially form an "L" shape, a first channel portion 460 and a second channel portion 465. The first back portion 410 may include apertures 420 for fasteners 700 to pass through. The back of the first channel portion 460 may be formed by first back portion 410, the side of the channel 460 may be formed by the second front portion 445 and the front of the channel 460 may be formed by the first front portion 440. The back of the second channel member 465 may be formed by second back portion 450, the side of the channel 465 may be formed by first back portion 410 and the front of the channel 465 may be formed by the second front portion 445. Protrusions 430, 435 may be located in the channels 460, 465. The protrusions 430, 435 may be substantially similar to protrusion 230 described above with reference to FIG. 2. In this exemplary embodiment, the inside corner trim piece 400 is shown as being asymmetrical. In alternate embodiments, the trim piece 400 may be symmetrical such that both the first and second back portions 410, 450 of the trim piece have apertures 420 for fastening the panel. In other embodiments, the trim piece may be symmetrical where the apertures 420 are only located on one of the first or second back portions 410, 450. The back portion may be resiliently flexible, for example allowing the back portion to be bent in order to allow the channel portion 240 some freedom of movement to aid in mounting and removal of the panel.

Figure 5A:
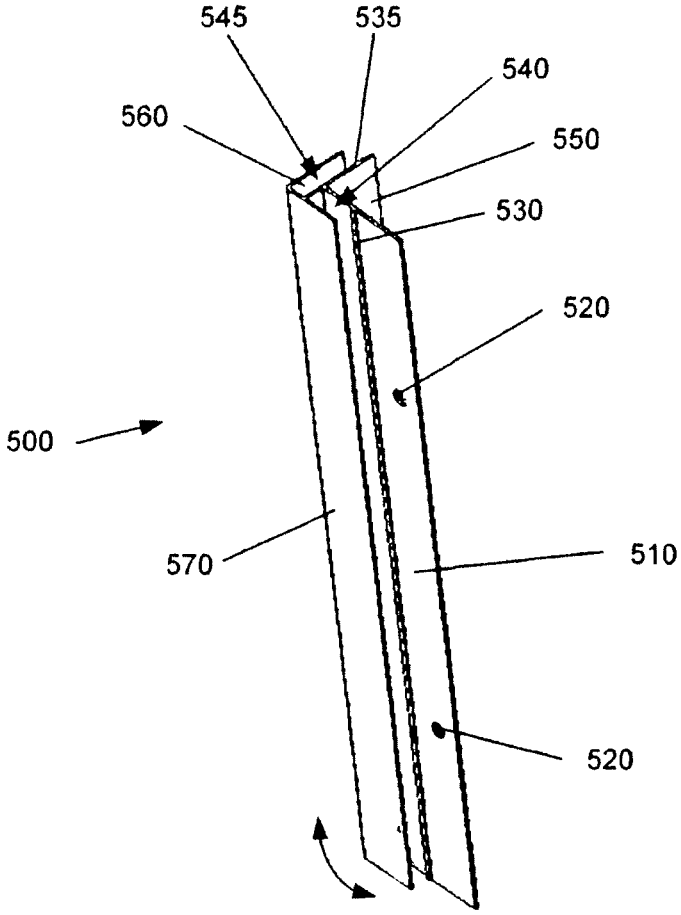
FIG. 5A illustrates a schematic view of another trim piece in accordance with an exemplary embodiment.

Referring now to FIG. 5A, an exemplary outside corner trim piece 500 is shown. The outside corner trim piece 500 may have any suitable length. For example, the outside corner trim piece 500 may have a length that is substantially equal to the height H of the panel 100. In alternate embodiments the trim piece 500 may have a length that is greater or less than the height H of the panel 100. The trim piece 500 may be made of any suitable material including, but not limited to, plastics, metals, composites or any combination thereof. The outside corner trim piece 500 may be configured to span the corner joint between two pieces of panel 100 and provide a finished look at the corner joint. For example, the outside corner trim piece 500 may have a first back portion 510 and a second back portion 550 that substantially form an "L" shape, a first channel portion 540 and a second channel portion 545. The first back portion 510 may include apertures 520 for fasteners 700 to pass through. The back portion may be resiliently flexible, for example allowing the back portion to be bent in order to allow the channel portion 240 some freedom of movement to aid in mounting and removal of the panel. The back of the first channel portion 540 may be formed by first back portion 410, the side of the channel 540 may be formed by the second back portion 550 and the front of the channel 540 may be formed by the first front portion 570. The back of the second channel member 545 may be formed by second back portion 550, the side of the channel 545 may be formed by the first front portion 570 and the front of the channel 545 may be formed by the second front portion 560. Protrusions 530, 535 may be located in the channels 540, 545. The protrusions 530, 535 may be substantially similar to protrusion 230 described above with reference to FIG. 2. In this exemplary embodiment, the outside corner trim piece 500 is shown as being asymmetrical. In alternate embodiments, the trim piece 500 may be symmetrical such that both the first and second back portions 510, 550 of the trim piece have apertures 520 for fastening the panel. In other embodiments, the trim piece may be symmetrical where the apertures 520 are only located on one of the first or second back portions 510, 550.

Figure 5B:
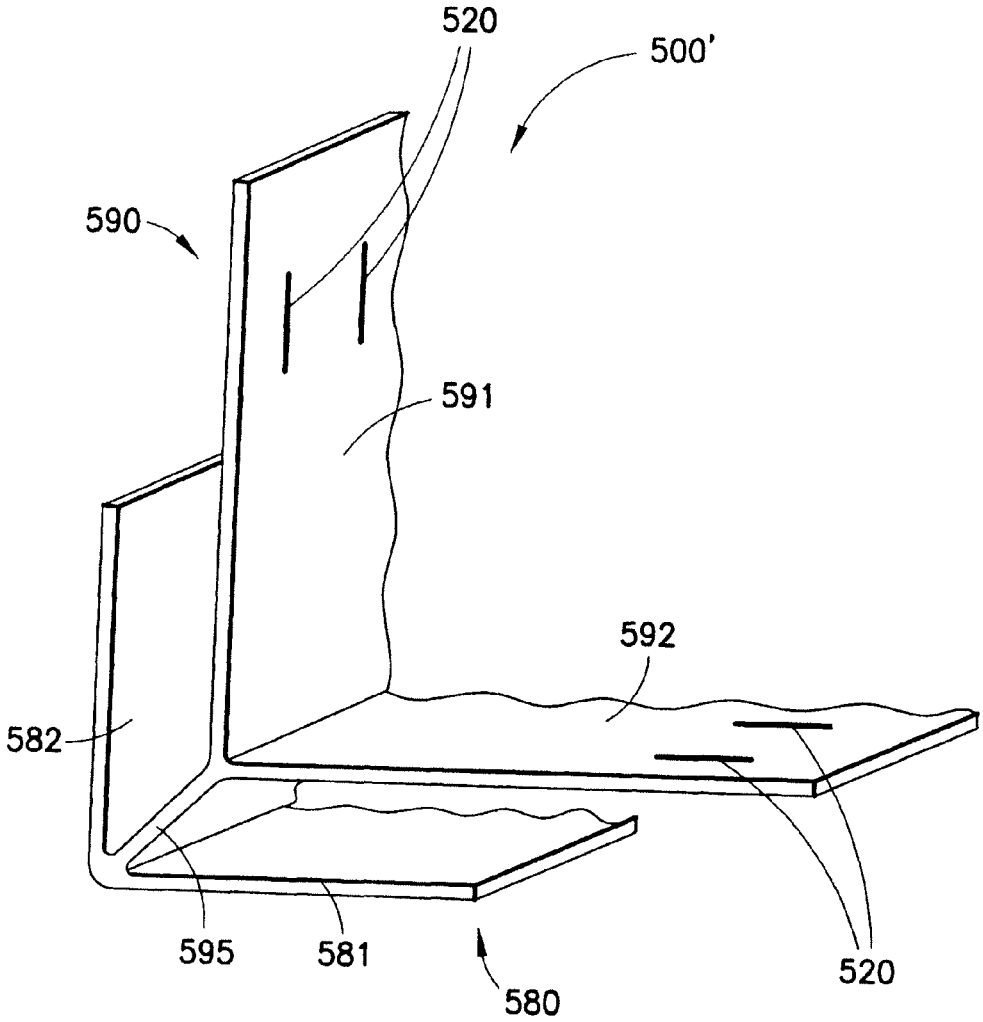
FIG. 5B illustrates a schematic view of an trim piece in accordance with an exemplary embodiment.

In another exemplary embodiment as shown in FIG. 5B, the outside corner trim piece 500' may have an inner portion 590 and an outer portion 580 which are joined to each other by a joining member or web 595. The trim piece 500' may be made of any suitable material including, but not limited to, plastics, metals, composites or any combination thereof. The inner portion 590 may be configured to span an edge of a wall or act as a free standing inside corner. The inner portion 590 may have a first side 591 for abutting a first wall surface and a second side 592 for abutting a second wall surface where the first and second wall surface form an outside corner of the wall. Each of the first and second sides 591, 592 may have one or more holes or apertures 520 for the insertion of a fastener as described above for securing the trim piece 500' to the wall surface. In alternate embodiments the inner portion 590 may only have apertures 520 on one of the sides 591, 592. The outer portion 580 may have a first side 581 and a second side 582, which are joined to each other along an edge of the web 595. The outer portion 580 may be suitably spaced apart from the inner portion 590 via the web 595 so that a panel 100 can be inserted between the inner portion 590 and the outer portion 580. For example, a wall panel 100 may be inserted between side 581 of the outer portion 580 and the side 592 of the inner portion 590. The panel 100 may be held in the channel formed by the sides 591, 592 and 582, 591 in any suitable manner including but not limited to, friction, mechanical or chemical fasteners, adhesives or by fitting the panel 100 between two trim pieces.

It should be realized that both the inside and outside corner trim pieces can be manufactured to form any suitable angle. For example, in the drawings the corner trim pieces are shown as being configured to wrap around a corner having a substantially ninety-degree angle but in alternate embodiments the corner trim pieces can be configured to wrap around an angle that is greater or less than ninety-degrees. In still other embodiments, the corner trim pieces may be suitably hinged so they can be adjusted to fit any suitable corner angle.

Figure 6D:
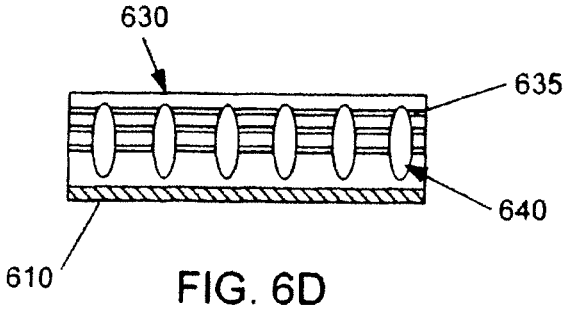
FIG. 6A-C illustrate a trim piece in accordance with an exemplary embodiment and FIGS. 6D and 6E illustrate portions of the trim piece in FIG. 6A in accordance with an embodiment.
Figure 6A:
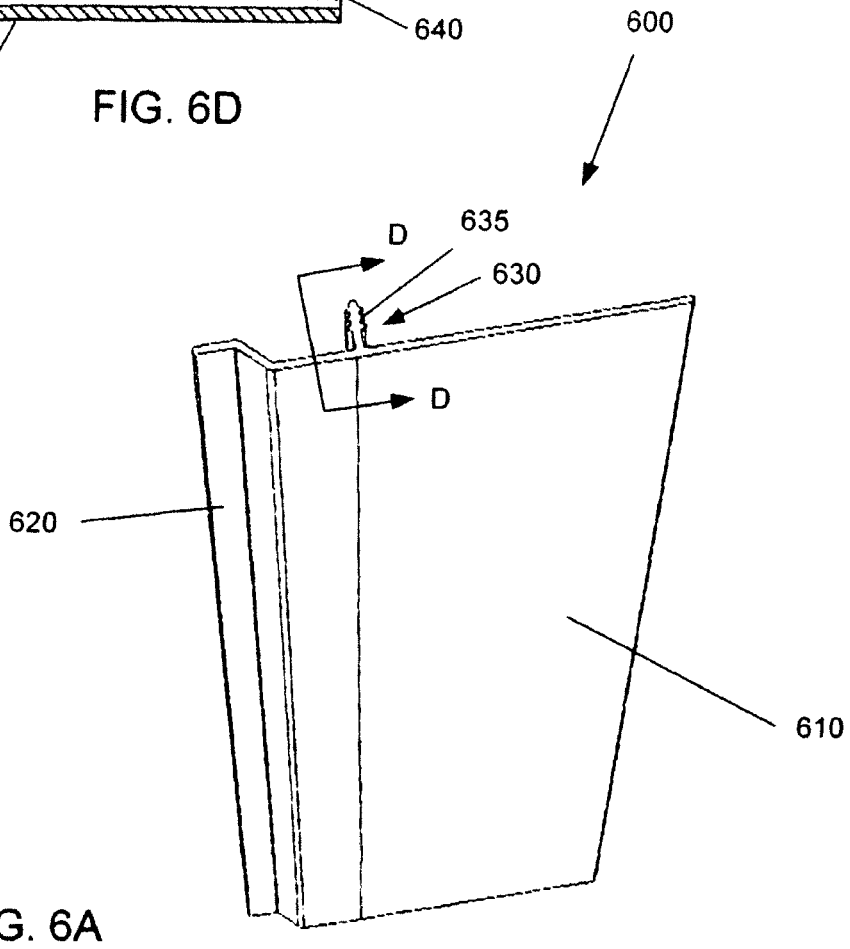

An exemplary bottom trim piece 600 is shown in FIG. 6A. The bottom trim piece 600 may have any suitable length. For example, the bottom trim piece 600 may have a length that is substantially equal to the width W of the panel 100. In alternate embodiments the trim piece 600 may have a length that is greater or less than the width W of the panel 100. The trim piece 600 may be made of any suitable material including, but not limited to, plastics, metals, composites or any combination thereof. The bottom trim piece 500 may be configured to retain the bottom edge 100B of the panel and provide a finished look between the panel 100 and a floor. For example, the bottom trim piece 600 may have a front portion 610 and a recessed portion 620. The front portion 610 may have a reward facing projection 630 that may support the bottom edge 100B of the panel when the panel is installed over a wall surface. In alternate embodiments the panel 100 may be suspended above the reward facing projection 630 by, for example the fasteners 700 that are inserted through the apertures in the trim pieces 200, 300, 400, 500.

The rearward facing projection 630 may also have ribs 635 extending from either side of the projection 630. In one exemplary embodiment, these ribs may be used to secure the bottom trim piece 600 into a channel that has been fixed to a wall surface as can be seen in FIG. 6F or into a channel provided in the panel 100 that is configured to receive the projection 630. As can be seen in FIG. 6F, a mounting plate 625 may be secured to the wall surface. The mounting plate 625 may be made of any suitable material including, but not limited to, plastics, metals, composites or any combination thereof. The mounting plate 625 may include a backing plate 627 and an attachment channel 626. The backing plate 627 may be secured to the wall surface in any suitable manner including but not limited to mechanical or chemical fasteners and adhesives. The backing plate may have one or more apertures for securing the panel to the wall surface as described above. The rearward facing projection 630 of the bottom trim panel 600 may be inserted into the channel 626 of the mounting plate 625 as shown in FIG. 6F. The ribs 635 of the projection 630 may interact with corresponding ribs 635A inside the channel 626 to secure the bottom trim piece 600 to the mounting plate 625.

The rearward facing projection 630 and the channel 626 may extend along the entire length of the bottom trim piece 600 and mounting plate 625. In alternate embodiments the rearward facing projection may extend along only a portion of the length of the trim piece 600. In other alternate embodiments the rearward facing projection 630 may extend intermittently along the length of the panel 600 as can be seen in FIG. 6E.

Figure 6E:
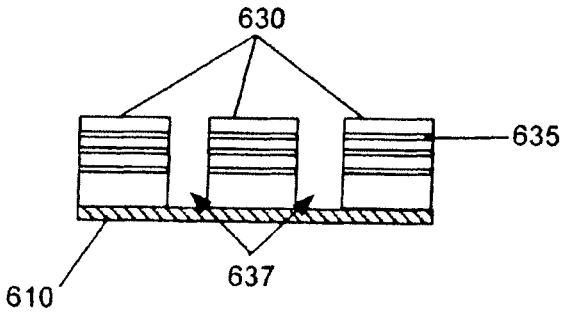

As can be seen in FIGS. 6D and 6E, in another exemplary embodiment the ribs 635, 635A may channel moisture into the breaks 637 or apertures 640 in the protrusion 630 so that the moisture falls to a moisture collection or drainage system as will be described in greater detail below. In alternate embodiments, the rearward facing projection 630 and the channel 626 may be angled so that moisture is directed through holes in the backing plate 627 for communication with the moisture collection or drainage system, where the backing plate 627 has suitable standoffs for holding the backing plate 627 a suitable distance away from the wall surface. The reward facing projection 630 and or channel 626 may have a suitable length so that when the trim piece 600 is installed in a wall assembly there is a gap between the recessed portion 620 and the wall to which the wall assembly is mounted.

Figure 6B:
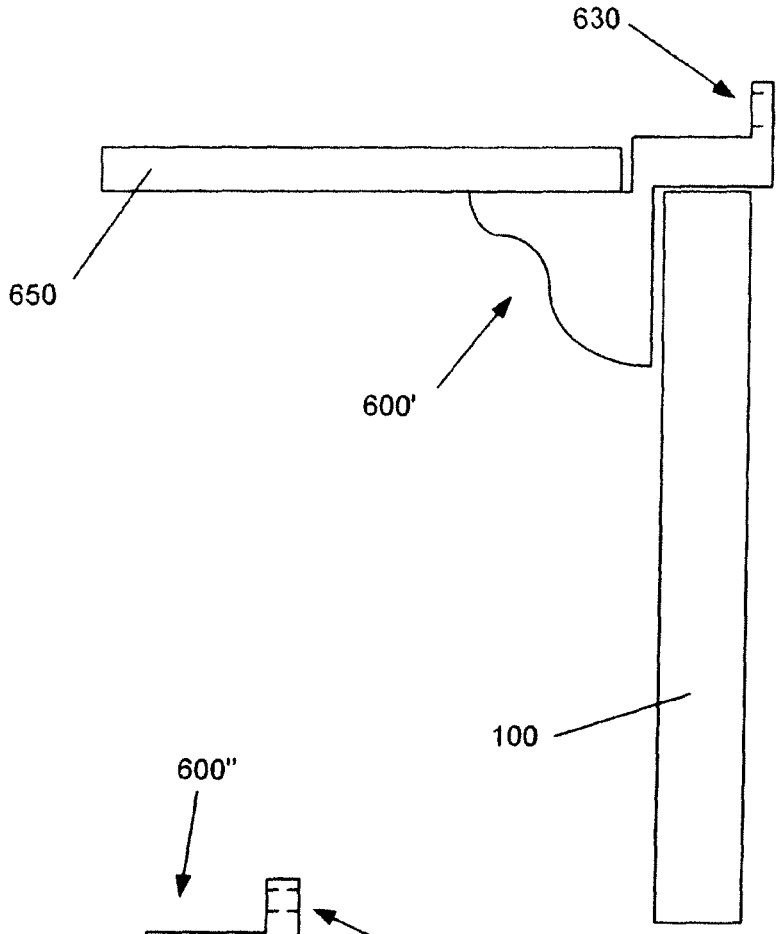
Figure 6C:
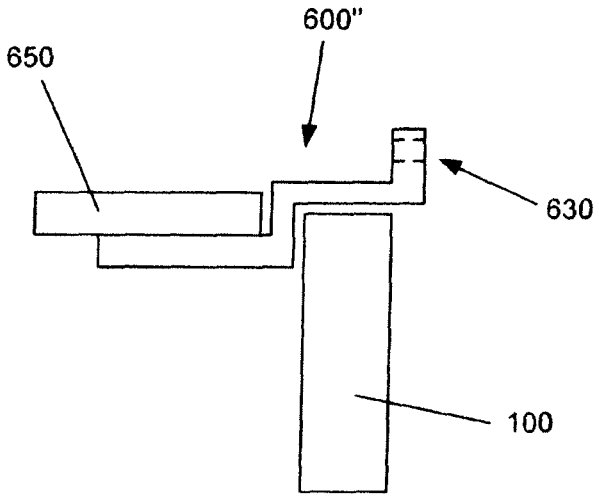
Figure 6F:
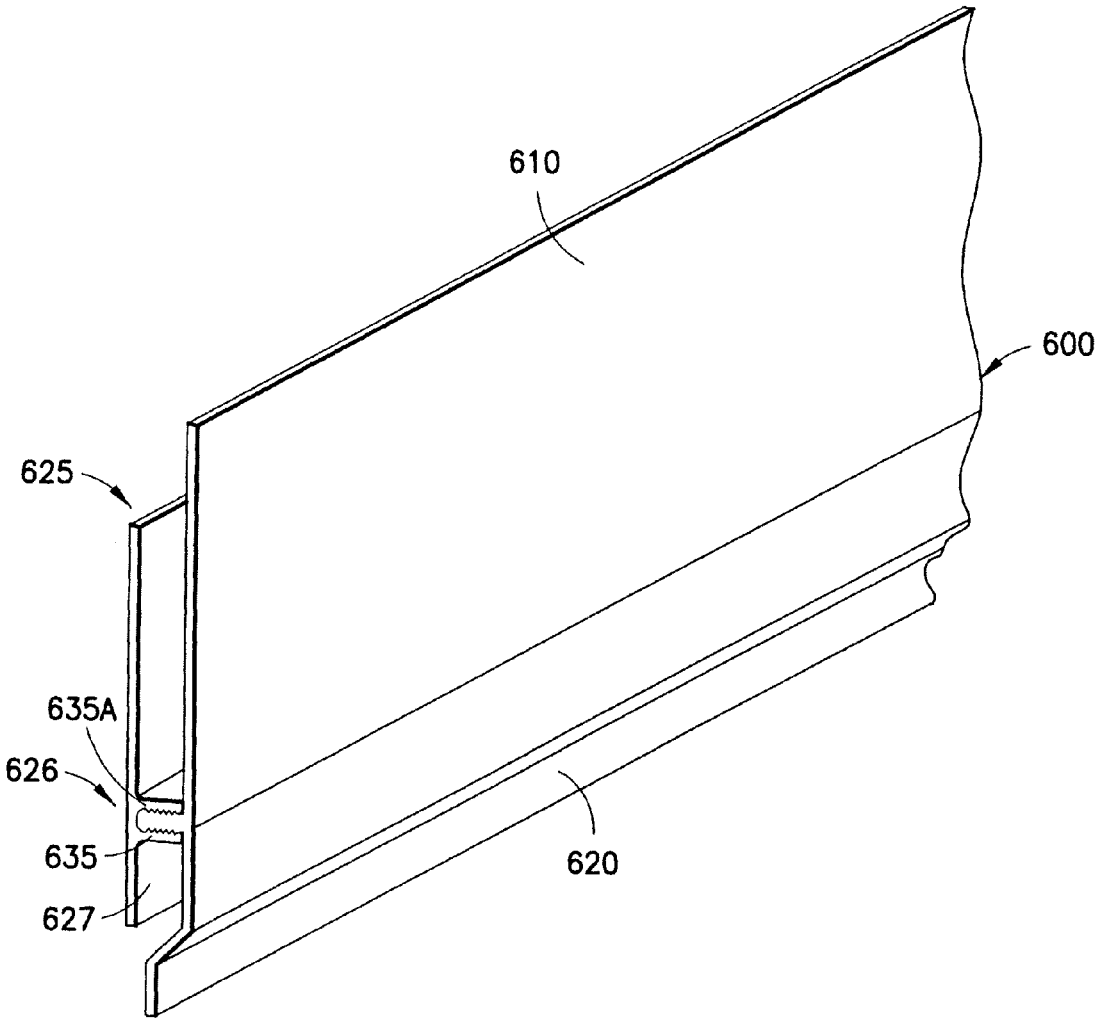
FIG. 6F illustrates an assembly including the trim piece of FIG. 6A.
Figure 7C:
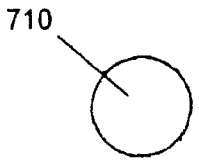
FIGS. 7A-D show schematic views of a fastener in accordance with an exemplary embodiment.
Figure 7D:
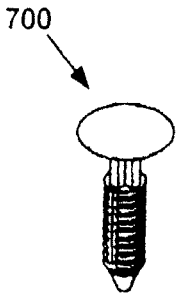
Figure 7A:
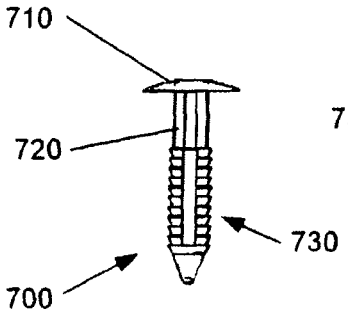
Figure 7B:
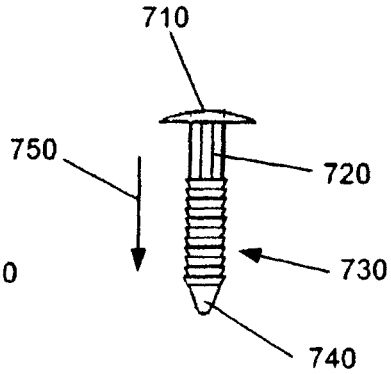

In one embodiment the bottom trim piece 600 may also be utilized as a top trim piece. In other embodiments, as can be seen in FIG. 6B the top trim piece 600' may be configured to include crown molding. As can be seen in FIG. 6B the top trim piece may have an aperture 630 for insertion of any suitable fastener so that the trim piece can be secured to a wall surface. In alternate embodiments the trim piece 600' may be secured to the wall in any suitable manner. The top trim piece may extend along the top of and in front of the panel 100 so that the top 100A of the panel is secured. The top trim piece may also extend outward, away from the panel 100 so that the crown molding portion of the top trim piece 600' supports an edge of a ceiling panel 650. In alternate embodiments the crown molding may be configured to sit against or be attached to, for example, a drywall ceiling. In other alternate embodiments the crown molding top trim piece 600' may have any suitable configuration or shape. As can be seen in FIG. 6C, the top trim piece 600" may be configured to support an edge of a ceiling panel 650 without having crown molding. The portion of the top trim panel 600" that extends beneath the ceiling panel may be configured to match the support structure for the ceiling panels 650 while at the same time securing the top 100A of the panel 100 against the wall surface.

Referring now to FIGS. 7A-D, an exemplary fastener 700 for securing the panel 100 to the various trim pieces is shown. It is noted that the shape of the fastener shown in FIG. 7A-D is for exemplary purposes only and that the fastener 700 can have any suitable configuration for securing the panel 100 to the trim pieces. The fastener may be made of any suitable material including, but not limited to, plastic, metal, composites or any combination thereof. The fastener 700 may also have any suitable size and properties to adequately support the panel 100 and prevent shearing of the fastener 700 under the weight of the panel 100. The fastener may have a head portion 710 and a body portion 720. In this example, the head portion 710 is shown as being circular and dome shaped but in alternate embodiments the head portion 710 may have any suitable configuration. The body portion may have a series of barbs 730 that are sloped from a tip 470 of the fastener 700 to the head 710 of the fastener 700. The barbs may provide a substantially one way direction of travel when the fastener 100 is inserted into the panel 100. For example, as the fastener 700 is inserted into the panel in the direction of arrow 750 the sloped characteristics of the barbs 730 allow for the motion in the direction of arrow 750, however if the fastener is pulled in a direction opposite that of arrow 750 the barbs spread and dig into an interior of the panel 100 preventing removal of the fastener 700. In alternate embodiments the fasteners 700 may have any suitable configuration and features so that the fasteners 700 are retained within the panels 100. For example, the fasteners may be any suitable expandable fasteners. The expandable fastener may have a push member and an expandable base member such that the expandable base member is inserted into the panel 100 and the push member is pushed through a central hole in the base member to force legs of the base member outward to secure the fastener in the panel.

The fasteners 700 may be inserted through the apertures, such as apertures, 220, 320, 420, 520 in the trim pieces and into corresponding pre-formed holes in the panel 100. In alternate embodiments the fasteners may be self-piercing such that as the fasteners pass into the panel 100 the fasteners create their own hole such that the barbs on the fasteners grip an interior portion of the panel so secure the fastener within the panel. In still other alternate embodiments the holes in the panel 100 may be created using a suitable tool, such as for example a punch, a drill bit, an awl or any other hole making tool, during the installation of the panel. In yet other alternate embodiments, the fasteners may be configured as quarter turn fasteners, screws or any other mechanical fastener.

Figure 8:
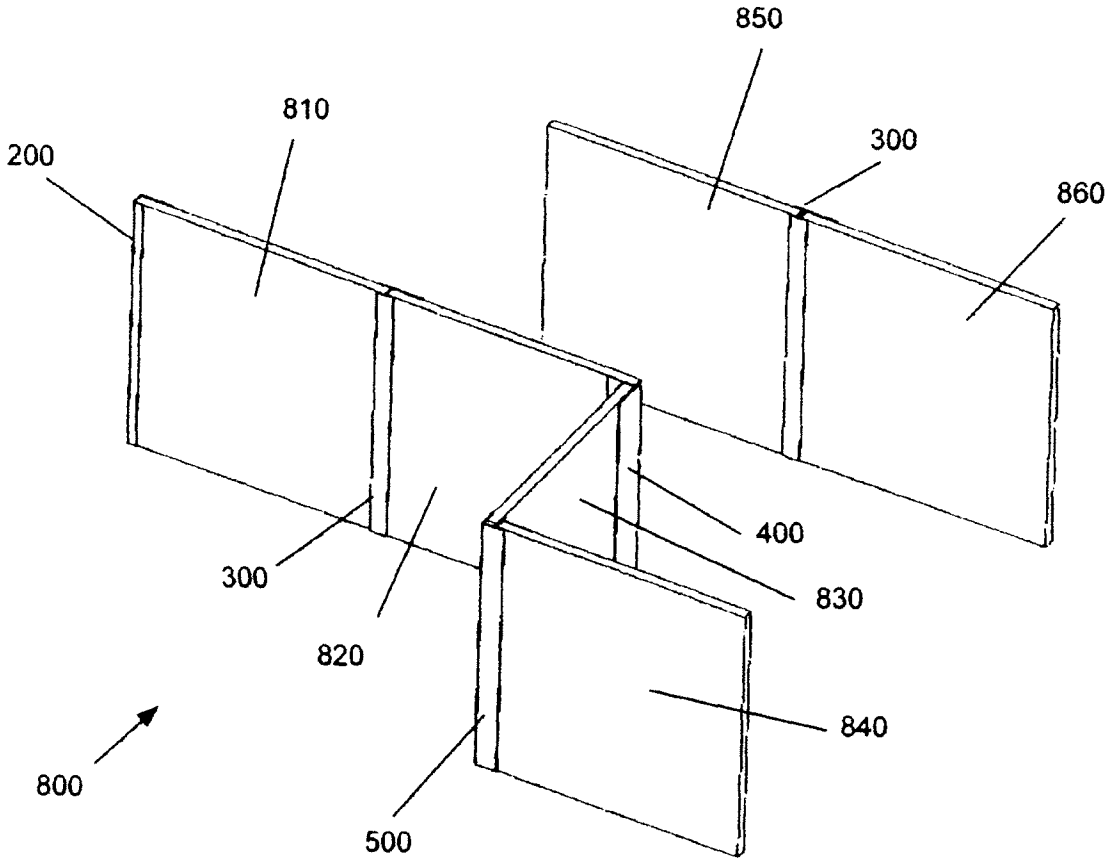
FIG. 8 illustrates an exemplary wall assembly in accordance with an exemplary embodiment.

Referring now to FIG. 8, a portion of an exemplary assembly 800 of the wall panels described herein is shown. In one exemplary embodiment, the wall paneling system described herein may be a finish wall paneling system where the wall panels form a finished wall surface of the interior room without using additional finishing panels, wall papers, paint and the like on or over the panel surface. In alternate embodiments, additional finishes may be placed over or on the paneling system surfaces. It is noted that the portions of the wall assembly are not shown in relation to any wall surface. In alternate embodiments, the trim pieces and/or panels may be secured to a wall surface as described above. In this exemplary embodiment the wall panels may be placed directly against the floor and ceiling such that the edge trim pieces 200 may be placed along the tops and bottoms 100A, 100B of the panels instead of the bottom trim piece 600 or top trim pieces 600', 600". As can be seen in FIG. 8, wall panel assembly 800 includes wall panels 810, 820, 830, 840, 850 and 860. The wall panels 810-860 may be substantially similar to panel 100 described above. Wall panels 810-840 form a first wall section and panels 850-860 form a second wall section. To form the first wall section, an end trim piece 200 is affixed to one side of panel 810 while the other side of panel 810 is inserted into a first channel of the spanning trim piece 300. The back portion of the trim piece 300 may be resiliently flexible so that the user can pull or bend the trim piece so that the channel is substantially aligned with the panel 810 to aid in mounting and removal of the panel. As may be realized, the corner trim pieces and the top and bottom trim pieces may also be resiliently flexible so that their respective channels can be substantially aligned with the wall panel to aid installation or removal of the panel. The resiliently flexible back portion of the trim pieces may allow removal of the panel without the removal of the trim piece from the wall surface and vice versa. The panels may be secured to the trim pieces using the fasteners 700 as described above. In alternate embodiments the panels may be secured to the trim pieces in any suitable manner. A first side of the panel 820 is inserted into the second channel of the spanning trim piece 300 while the second side of the panel 820 is inserted into a first channel of the inside corner trim piece 400. A first side of panel 830 is inserted into a second channel of the inside corner trim piece 400 and the second side of the panel 830 is inserted into the a first channel of the outside corner trim piece 500. A first side of the panel 840 is inserted into the second channel of the outside corner trim piece 500 to complete the first wall portion. The second wall portion is shown having panels 850, 860 joined by a spanning trim piece 300. In alternate embodiments the first and second wall portions may include any suitable number of panels and trim pieces and may be connected to each other by additional wall members to form, for example four walls of a room.

Figure 9:
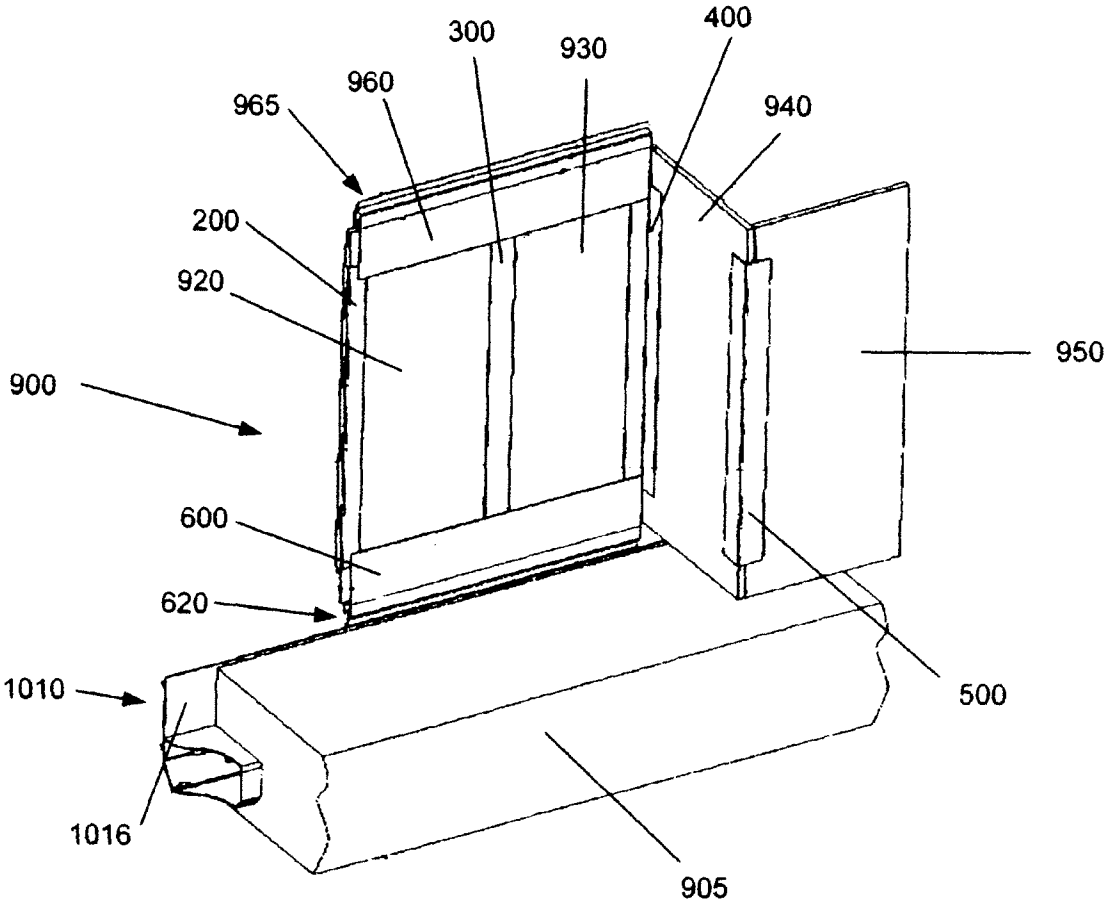
FIG. 9 illustrates another exemplary wall assembly in accordance with an exemplary embodiment.

Referring now to FIG. 9, a wall assembly 900 is shown being installed on a sub-floor. The wall assembly is installed in cooperation with a sub-floor drain conduit 1010 to form a water control system. In one exemplary embodiment the sub-floor drain conduit may be substantially similar to the conduit described in commonly owned U.S. Pat. No. 5,501,044, entitled "SUB-FLOOR DRAIN CONDUIT FOR WATER CONTROL SYSTEMS" which is incorporated herein by reference in its entirety. In other exemplary embodiments, the sub-floor drain conduit may be any suitable drain conduit of any suitable drainage system.

Figure 10:
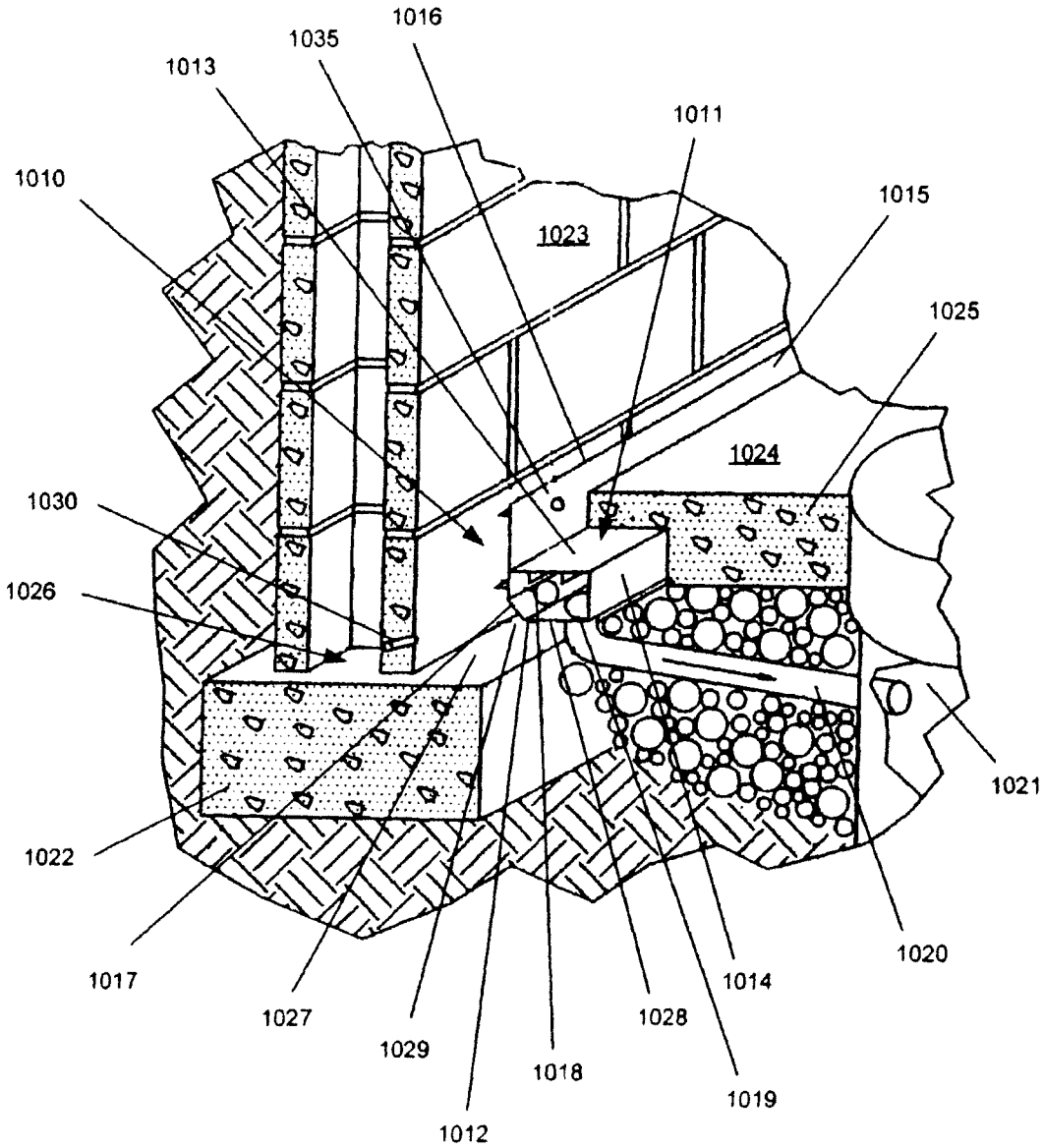
FIG. 10 illustrates a drainage system in accordance with an exemplary embodiment.
Figure 11:
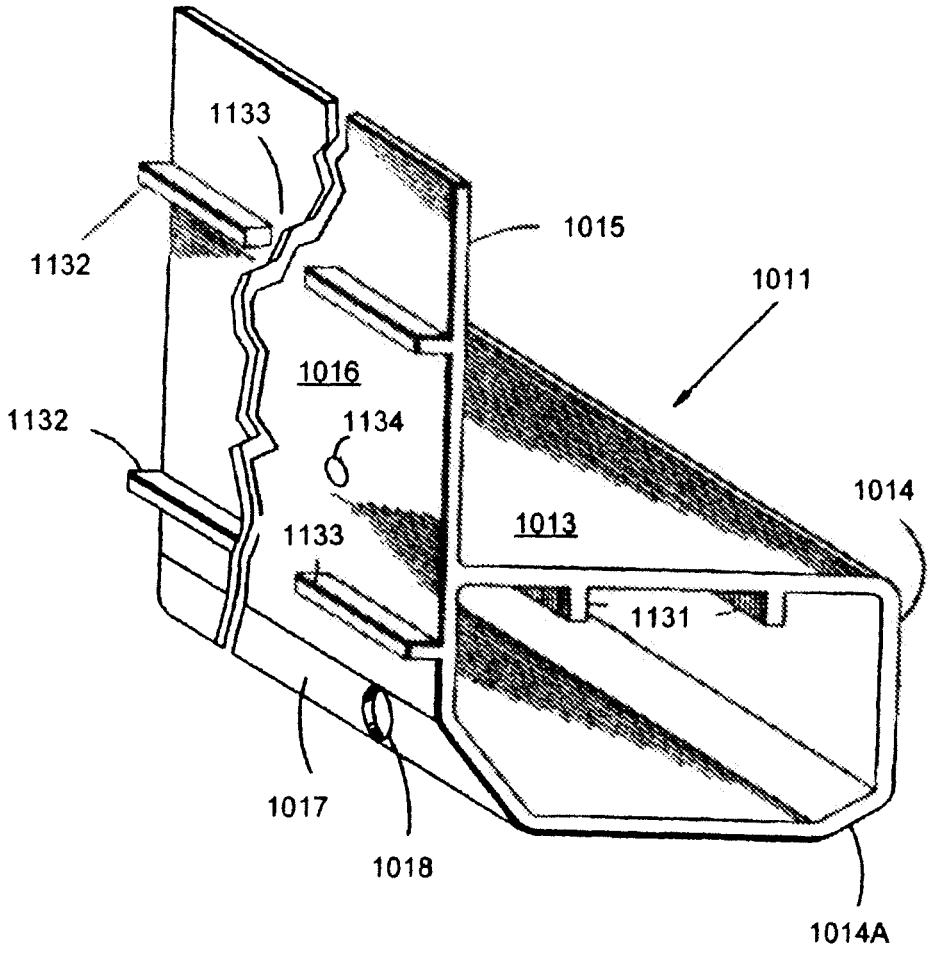
FIG. 11 is a perspective view of a section of drainage conduit in accordance with an exemplary embodiment.
Figure 12:
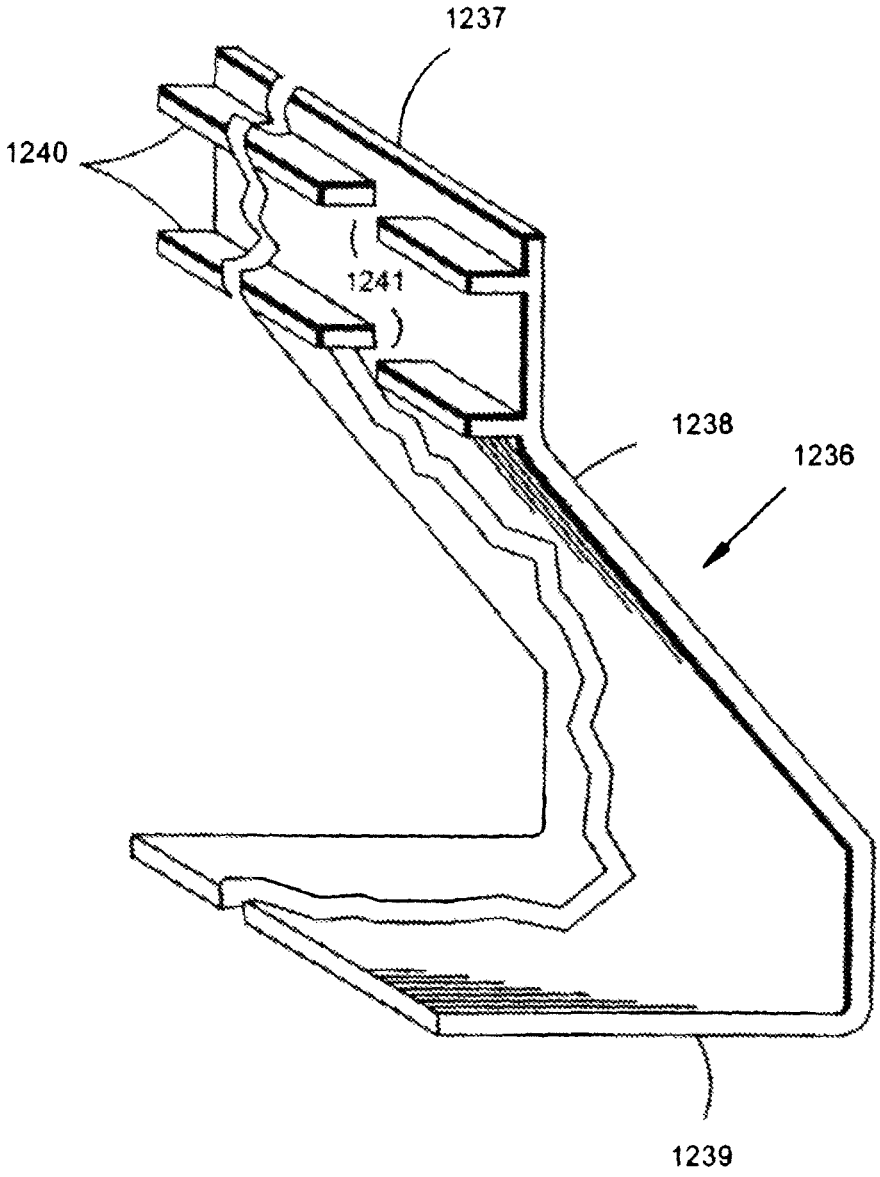
FIG. 12 is a perspective view of a section of drainage conduit in accordance with another exemplary embodiment.

Referring to FIGS. 10-12, the sub-floor drainage conduit comprises a somewhat-rectangular elongate tubular conduit section 1011 having a horizontal base floor wall 1012, a horizontal top or roof wall 1013, an outer wall 1014 having a vertical upper portion and a lower portion 1014A inclined toward the center of the drainage conduit, and an inner wall 1015 having a vertical upper wall portion 1016 and an inwardly inclined lower wall portion 1017 which is provided with a plurality of water-inlet openings 1018, spaced along the length of the inclined lower wall portion 1017, such as at 3" intervals. The illustrated section of drainage conduit 1010 has a floor drain 1019 to a drain pipe 1020 opening into a sump pump enclosure 1021. The elongate drainage conduit 1010, consisting of united lengths of such conduit, has one such floor drain 1019 to which trapped water flows by gravity for discharge to a remote location.

FIG. 10 illustrates the installation location of the drainage conduit 1010 at the interface between the foundation or footing 1022 of the walls 1023 and the base of a concrete block wall 1023, below the upper surface 1024 of the concrete floor 1025 of a basement or other subterranean room. The footing 1022 has a flat, horizontal upper surface 1026, which supports the wall 1023, and which has inner and outer ledges, which extend beyond the wall 1023. The inner ledge 1027 engages the bottom wall 1012 and supports the drainage conduit 1010, and an inner edge portion 1028 of the ledge 1027 is notched to accommodate the neck of the drain pipe 1020 and enable the drainage conduit 1010 to lie flat against the surface of the ledge 1027.

As illustrated, the outer face of the inclined lower wall portion 1017 of the drainage conduit 1010 forms between itself and the wall-ledge interface an elongate water passage 1029 of triangular cross-section which is open to wall bores 1030, a spaced plurality of which are drilled into the concrete block wall 1023 adjacent the wall-ledge interface, and is also open to the water inlet holes 1018 spaced along the inclined wall portion 1017 of the conduit 1010.

The opposed vertical wall 1014 of the drainage conduit 1010 includes a lower wall section 1014A that is sloped downwardly and inwardly toward the center of the drain. This shape facilitates an easier installation in that the drainage conduits will more easily conform to a roughly jackhammered excavation in the concrete floor, which will tend to be sloped towards its center.

The wall bores 1030 are spaced about every 4 to 8 inches along the base of the concrete block wall 1023 to admit exterior groundwater from each block interior space and relieve hydrostatic pressure. The incoming water flows through the triangular water passage 1029, over the surface of the footing ledge 1027, and enters the tubular section 1011 of the drainage conduit 1010 through the nearest water-inlet openings 1018 for gravity flow to the floor drain 1019 and into the sump pump enclosure 1021. Openings 1018 preferably are spaced from each other by about 3" and have a diameter of about ¾". In the case of poured concrete walls rather than concrete block walls 1023, as illustrated in FIG. 10, no bore holes 1030 are drilled since the incoming groundwater enters between the base of the wall and the upper surface of the footing. With concrete block walls 1023, the concrete blocks are hollow with 2 or 3 vertical air spaces into which ground water can penetrate, and a bore 1030 is drilled into each air space to relieve the hydrostatic pressure therewithin.

The structural features of the drainage conduit 1010 according to one exemplary embodiment are illustrated most clearly by FIG. 11. The flat roof wall 1013 of the conduit 1010 is formed with a spaced pair of interior longitudinal vertical ribs 1131 which extend the length thereof and reinforce or strengthen the roof section 1013 against distortion or deflection under the weight of the narrow peripheral edge of the concrete floor 1024 applied thereover after installation, as illustrated by FIG. 10.

More important features of the drainage conduit 1010 of FIG. 11, more particularly of the vertical upper wall portion 1016 of the inner wall section 1015, are spacer means comprising a space pair of segmented stand-off ribs 1132 extending horizontally from the rear face of the wall portion 1016 to space the rear face from the basement walls 1023 by a distance, such as about ⅜", when installed. The segmented ribs 1132 provide a plurality of spaced openings 1133, one about every three inches, which permit any water which forms upon or penetrates the inside surface of the basement wall 1023 to run down behind the conduit wall portion 1016 and through the openings 1133 in the stand-off ribs 1132 to enter the water passage 1029 and conduit inlet openings 1018 for discharge. This feature adapts the water control system and drainage conduits 1010 for use with basement walls which have water leaking down them from condensation, cracks, mortar joints, pipe penetrations, window wells etc. to the basement floor 1024, by providing a vertical drainage space along the wall/floor interface. The vertical upper wall 1016 portion extends upward above the finished floor 1024 to prevent the entry of dirt and debris and small objects from the surface of the floor 1024, ensuring the preservation of the wall drainage space created.

FIGS. 10 and 11 also illustrate spaced attachment holes 1134 through the upper vertical wall section 1016, and masonry nails 1035 therethrough for fastening the elongate sub-floor drainage conduit 1010 to the basement wall 1023 and holding it in place prior to and during the recementing of the peripheral edge of the basement floor 1024 or prior to and during the laying of the cement floor 1024, in the case of original construction. These holes may not be utilized in many installations if the drainage conduit is setting satisfactorily prior to pouring the floor, but they are small enough that no concrete will pass therethrough if they are not used for fastening and remain open.

The drainage conduit enclosure 1236 according to the embodiment illustrated by FIG. 12 is a simplified structure which is capable of being extruded inexpensively and which does not require the after-step of forming water-inlet holes such as holes 1018 of the embodiment of FIGS. 10 and 11.

The enclosure 1236 of FIG. 12 comprises a vertical upper wall portion 1237 integral with a lower semi-hemispherical conduit section having a wall portions 1238 which extends outwardly and downwardly from the vertical upper wall portion 1237 to a horizontal floor or base portion 1239 which extends inwardly towards the wall/footing interface on the top surface of the footing.

The inside surface of the upper wall portion is provided with spacer means similar to those illustrated in FIG. 11. Thus, a spaced pair of integrated longitudinal ribs 1240 are extruded in situ and thereafter provided with spaced openings 1241 to permit vertical drainage of water therethrough down to the wall/footing interface for entry into the open conduit section, over the floor or base portion 1239 and peripheral drainage to a drain hole, not shown, open to a disposal drain pipe. The semi-hemispherical conduit section, comprising the wall portion 1238 and floor portion 1239, substantially-retains the water admitted through or down the basement wall or through the wall/footing interface and substantially prevents such water from flowing freely outwardly from the wall and down beside the footing. Instead the conduit section channels the admitted water freely over the floor portion 1239 and over the footing, peripherally to one or more drain openings.

The base wall or floor portion 1239 need only extend a slight distance inwardly over the surface 1027 of the footing 1022 to support the conduit element 1236 against the surface 1027 and deter movement of the admitted groundwater outwardly towards the edge of the footing. Preferably the floor portion 1239 extends nearly to the wall/footing interface, to provide a water-impervious floor for the conduit section.

Referring back to FIG. 9, the exemplary wall assembly 900 may include wall panels 920, 930, 940, 950, an end trim piece 200, an intermediate trim piece 300, an inside corner trim piece 400, an external corner trim piece 500, a top trim piece 960 and a bottom trim piece 600. It is noted that the tri pieces may include resiliently flexible portions as described above to aid in the installation and removal of the wall panels so that the trim pieces do not have to be removed from the wall surface. The wall panels 920, 930, 940, 950 and trim pieces 200, 300, 400 may be assembled in a manner that is substantially similar to that described above with respect to FIG. 8. The upper trim piece 960 may be substantially similar to trim piece 600 described above with reference to FIG. 6. The top trim piece may be secured to the top of the panel, for example panels 920, 930, in any suitable manner. A recessed portion 965 of upper trim piece 960 may be tucked between a wall surface and an edge of a ceiling surface to secure the top portion of the panel to the wall. In other embodiments the recessed portion 965 may be configured to be secured directly to the wall surface and/or ceiling surface. The bottom trim piece 600 may be secured to the bottom portion of, for example, panels 920, 930 in any suitable manner. It is noted that while wall panels 940, 950 are not shown in the Figures as having upper and lower trim pieces 960, 600 for clarity purposes that the upper and lower trim pieces 960, 600 may be installed on any of the panels in the wall assembly 900 as required. A recessed portion 620 of the trim piece 600 may be tucked between, for example the wall surface 1023 and the vertical upper wall portion 1016 of conduit 1010. In other embodiments where the enclosure 1236 of FIG. 12 is utilized the recessed portion 620 of the trim piece 600 may be tucked between the wall surface 1023 and the vertical wall portion 1237. In alternate embodiments, the vertical wall portions 1016, 1237 may be configured to hold and retain the bottom edge of the panels 920, 930, 940, 950. In still other alternate embodiments, the vertical wall portions 1016, 1237 may have a sliding lip for engaging and attachment to the bottom trim piece 600 and/or to increase a height of the flashing formed by the vertical wall portions 1016, 1237 to further prevent water or moisture from entering the area in which the wall panels are installed.

As noted above the rearward facing projection 630 is configured to provide a gap between the wall 1023 and the recessed portion 620 such that any water or moisture that builds up behind the wall panels 920, 930, 940, 950 travels down the back side of the respective panel and is channeled through the gap between the wall 1023 and the recessed portion 620 as well as the gap between the wall 1023 and the vertical portion 1016 so the water or moisture enters the conduit 1010 for drainage as described above.

As may be realized, the bottom trim piece 600 and the conduit 1010 may be configured so that they may be installed below or along the bottom of the interior and exterior corner trim pieces 400, 500 so that water can drain into the conduit in the manner described above.

The embodiments described herein provide a wall panel system that provides wall waterproofing, insulation and finishing. The wall panels are provided with a vapor barrier along at least the back and bottom of the panels so that the wall panels can be applied directly over a wet wall surface without any deterioration of the wall panels. In other embodiments, the vapor barrier may also cover at least a portion of the sides and front of the wall panels. Any moisture that builds up behind the wall panels flows down the back of the wall panels and is guided by, for example, the bottom trim pieces of the wall system, into a drainage conduit. The water that is introduced into the drainage conduit flows into a sump pump area for removal from the living area. In other embodiments, the wall panel may be placed over or adjacent to dry wall surfaces.

It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

What is claimed is:

1. A wall paneling system comprising:

at least one finish wall panel configured to prevent moisture from entering an interior of the wall panel and having a finish with a predetermined finished characteristic thereon, the at least one finish wall panel having a trim piece for mounting the at least one wall panel to a wall surface; and a drainage system joined to the at least one wall panel, the drainage system having an upward extending wall portion where a channel is formed between the upward extending wall portion and the wall surface, the trim piece extending into the channel between the upward extending wall portion and the wall surface so that the trim piece of the at least one wall panel directs moisture into the drainage system for removal of the moisture away from the at least one wall panel;

wherein the drainage system comprises an elongate conduit placed along and substantially covered by peripheral edges of a floor of a room and below a surface of the floor of the room in which the wall paneling system is installed.

2. The wall paneling system of claim 1, wherein at least one of the at least one trim pieces is configured to interface with the drainage system, wherein moistures travels down a back surface of the at least one wall panel and is directed into the drainage system by the at least one trim piece configured to interface with the drainage system.

3. The wall paneling system of claim 2, wherein the at least one trim piece includes standoffs for creating a gap between the at least one wall panel and a wall surface.

4. The wall paneling system of claim 1, wherein a vapor barrier covers a back surface of the at least one wall panel.

5. The wall paneling system of claim 1, wherein a vapor barrier covers a bottom of the at least one wall panel.

6. The wall paneling system of claim 4, wherein the vapor barrier covers at least a portion of a first and second side surfaces and at least a portion of a front surface of the at least one wall panel.

7. The wall paneling system of claim 1, wherein the at least one trim piece includes a resiliently flexible portion configured to allow installation or removal of the at least one wall panel without removing the at least one trim piece from the wall surface.

8. The wall paneling system of claim 1, further comprising a decorative fascia covering the front surface.

9. The wall paneling system of claim 1, wherein the back surface is textured to allow for moisture drainage and/or installation over uneven surfaces.

10. A wall panel comprising:

a front surface;

a back surface;

a first side surface connecting the front and back surfaces;

a second side surface connecting the front and back surfaces;

a bottom surface connecting the front and back surfaces;

a vapor barrier distinct from insulation of the panel, the vapor barrier covering at least the back surface and the bottom surface; and a trim piece interfacing with the bottom surface, the trim piece interfacing with a drainage system substantially covered by a surface of a floor, the drainage system having an upward extending wall portion where a channel is formed between the upward extending wall portion and a wall surface, the trim piece extending into the channel between the upward extending wall portion and the wall surface, wherein moisture travels down the vapor barrier and is directed into the drainage system by the trim piece.

11. The wall panel of claim 10, wherein the vapor barrier is configured to prevent moisture from entering an interior of the panel.

12. The wall panel of claim 10, wherein the vapor barrier covers at least a portion of the first and second side surfaces and the front surface includes a decorative fascia.

13. The wall panel of claim 10, wherein the wall panel is configured to be placed against or adjacent to a wet wall surface.

14. The wall panel of claim 10, further comprising a decorative fascia covering the front surface.

15. The wall panel of claim 10, wherein the back surface is textured to allow for moisture drainage and/or installation over uneven surfaces.

16. The wall panel of claim 10, wherein the wall panel comprises an insulating wall panel.

17. A room finishing, insulation and water drainage system comprising:

at least one insulative wall panel configured to be installed over a wall surface in a room and to prevent a passage of moisture through the panel and into the room thereon, the at least one insulative wall panel having a trim piece for mounting the at least one insulative wall panel to the wall surface; and a drainage system joined to the at least one wall panel, the drainage system having an upward extending wall portion where a channel is formed between the upward extending wall portion and the wall surface, the trim piece extending into the channel between the upward extending wall portion and the wall surface so that the trim piece of the at least one wall panel directs moisture into the drainage system for removal of the moisture away from the at least one wall panel;

wherein the drainage system comprises an elongate conduit placed along and substantially covered by peripheral edges of a floor of a room and below a surface of the floor of the room in which the room finishing system is installed.

18. The room finishing, insulation and water drainage system of claim 17, wherein the at least one insulative wall panel comprises a decorative fascia covering the front surface.

19. The room finishing, insulation and water drainage system of claim 17, wherein a back surface of the at least one insulative wall panel is textured to allow for moisture drainage and/or installation over uneven surfaces.

20. The room finishing, insulation and water drainage system of claim 17, wherein at least one of the at least one trim pieces is configured to interface with the drainage system, wherein moistures travels down a back surface of the at least one wall panel and is directed into the drainage system by the at least one trim piece configured to interface with the drainage system.

21. The room finishing, insulation and water drainage system of claim 17, wherein a vapor barrier covers at least a back surface and a bottom of the at least one wall panel.

22. A wall panel comprising:

a fiberglass core;

a finished front surface joined to a first side of the fiberglass core, the front surface comprising a fascia with a predetermined finish characteristic thereon;

a back surface joined to a second side of the fiberglass core, the back surface comprising a vapor barrier distinct from insulation of the panel; and a trim piece interfacing with the vapor barrier, the trim piece interfacing with a drainage system substantially covered by a surface of a floor, the drainage system having an upward extending wall portion where a channel is formed between the upward extending wall portion and a wall surface, the trim piece extending into the channel between the upward extending wall portion and a wall surface, wherein moisture travels down the vapor barrier and is directed into the drainage system by the trim piece.

23. The wall panel of claim 22, wherein the finished front surface comprises a vinyl surface.

24. The wall panel of claim 22, wherein the finished front surface comprises a fabric surface.

25. The wall panel of claim 22, wherein the core includes sides and at least one side of the core has the vapor barrier.

* * * * *